US012491976B2

(12) United States Patent
Lambert

(10) Patent No.: US 12,491,976 B2
(45) Date of Patent: Dec. 9, 2025

(54) CONVERTIBLE STANDUP PADDLE BOARD PADDLE

(71) Applicant: Jerry L. Lambert, Honolulu, HI (US)

(72) Inventor: Jerry L. Lambert, Honolulu, HI (US)

( * ) Notice: Subject to any disclaimer, the term of this patent is extended or adjusted under 35 U.S.C. 154(b) by 498 days.

(21) Appl. No.: 18/058,717

(22) Filed: Nov. 23, 2022

(65) Prior Publication Data

US 2023/0219668 A1 Jul. 13, 2023

Related U.S. Application Data

(63) Continuation-in-part of application No. 29/791,314, filed on Jan. 7, 2022, now Pat. No. Des. 973,008.

(60) Provisional application No. 63/267,418, filed on Feb. 1, 2022.

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS

| | | | | |
|---|---|---|---|---|
| 3,037,219 | A | 6/1962 | Webb | |
| 3,362,033 | A | 1/1968 | Fee | |
| 4,303,402 | A | 12/1981 | Gooding | |
| 4,605,378 | A * | 8/1986 | Hamilton | B63H 16/04 440/102 |
| 4,622,017 | A | 11/1986 | McGraw | |
| 5,322,462 | A | 6/1994 | Hull | |
| 5,902,162 | A | 5/1999 | Kol | |
| 6,022,255 | A | 2/2000 | Lukanovich | |
| D656,880 | S | 4/2012 | Strangfeld | |
| 8,167,669 | B1 | 5/2012 | Xie | |
| 8,632,371 | B1 | 1/2014 | Ramsey | |
| 8,926,384 | B1 | 1/2015 | Alphin | |
| D739,804 | S | 9/2015 | Schweiger | |
| D772,135 | S | 11/2016 | Strangfeld | |
| 10,737,143 | B1 | 8/2020 | Raman | |
| 10,843,779 | B2 | 11/2020 | Roger | |
| 2011/0027101 | A1 | 2/2011 | Hartman | |

(Continued)

FOREIGN PATENT DOCUMENTS

| | | | |
|---|---|---|---|
| GB | 2201389 | A | 9/1988 |
| KR | 101862289 | B1 | 5/2018 |

(Continued)

*Primary Examiner* — Timothy D Collins
(74) *Attorney, Agent, or Firm* — Seth M Reiss, AAL, ALLLC; Seth M. Reiss

(57) ABSTRACT

Disclosed herein are systems and methods for a convertible standup paddle board (SUP) paddle. The convertible SUP paddle includes a first paddle end with a first, fixed blade, a second paddle end with a handle for gripping, and a shaft connecting the first paddle end to the second paddle end. Incorporated and housed within the handle end of the paddle shaft is a second, folding blade comprised of a plurality of overlapping/interlocking fan blades. The second folding blade is collapsed for SUP styles paddling and expanded for kayak-style paddling. Means for expanding, collapsing and locking the fan blades in either an expanded or collapsed format are also disclosed.

16 Claims, 9 Drawing Sheets

(56) References Cited

U.S. PATENT DOCUMENTS

| | | | | |
|---|---|---|---|---|
| 2013/0230398 | A1 | 9/2013 | Hall | |
| 2014/0111978 | A1 | 4/2014 | Laurence | |
| 2024/0262479 | A1 * | 8/2024 | Harris | B63H 16/04 |

FOREIGN PATENT DOCUMENTS

| | | | | |
|---|---|---|---|---|
| WO | 2008/102386 | A1 | 8/2008 | |
| WO | WO 2023/056404 | A1 * | 4/2023 | B63H 16/04 |

* cited by examiner

CONVERTIBLE STANDUP PADDLE BOARD PADDLE

CROSS-REFERENCE TO RELATED APPLICATIONS

This application claims the benefit of U.S. Design application 29/791,314 filed Jan. 7, 2022, now U.S. Pat. No. D973008, and U.S. Provisional Patent Application 63/267,418 filed Feb. 1, 2022, both by the present inventor, the contents of which are incorporated herein in their entirety.

STATEMENT REGARDING FEDERALLY SPONSORED RESEARCH OR DEVELOPMENT

The invention described herein was not made pursuant to a government agency grant or contract. No government funds were utilized in the described invention.

FIELD OF THE INVENTION

The present invention relates generally to paddles and oars and more specifically, to a convertible standup paddle board (SUP) paddle that can be used also as a kayak-style paddle.

BACKGROUND OF THE INVENTION

Riding waves using a surfboard or other flotation device has been popular among many water sport enthusiasts for ages. More recently, a variation of surf boarding known as standup paddle surfing or standup paddle boarding has gained in popularity among water sport aficionados due to its ease of use in riding waves and navigating longer distances on the water surface as compared to the traditional surfboards. Whereas, the surfboard is typically ridden in a crouching or semi-crouching position, and many support the rider only when the wave is breaking or nearly breaking, the standup paddle board (SUP) board is meant to be ridden in a standing posture and does not require the force of a breaking wave for support. Consequently, SUP boards are generally constructed with wider, thicker and longer bodies and are therefore, heavier than slimmer, lightweight, surfboards.

Stand up paddle boarding is a fast-growing sport that provides a fun, easy way to play on the water. With minimal equipment, users can paddle on anything from ocean surf to lakes and rivers. The paddling involved in standup paddle boarding offers a full body workout and is becoming a favorite cross-training and exercise activity.

A traditional SUP paddle has a handle on top and a single blade at the bottom. Many beginners who are still learning to balance on the SUP paddle board find it difficult to paddle standing up for long periods. Further, when such a beginner tires or the weather gets rough, the user may not be able to continue to balance on the SUP board and may fall in the water, or need to sit or lie on the SUP board, sometimes putting the user at risk.

Therefore, there exists a need to provide an enhanced SUP paddle that may help a user to easily propel and navigate the SUP while sitting or lying down on the paddle board, as for example during bad weather conditions and when the user is tired after standing for a long time on the SUP board.

SUMMARY OF THE INVENTION

According to embodiments illustrated herein, there may be provided a standup paddle board (SUP) paddle that is convertible to a kayak-style paddle. The SUP paddle comprises a first paddle end having a first fixed blade, a second paddle end comprising a handle for gripping the SUP paddle, and a shaft connecting the first paddle end with fixed blade to the second paddle end with handle for gripping. The convertible SUP paddle further comprises a housing incorporated into a portion of the paddle shaft proximate to the handle end of the paddle, and a second, collapsible blade comprising a plurality of interconnected fan blades expandable from within said shaft housing.

When used for standup paddling, the interconnected fan blades of the second blade are stored overlapping, in compressed format, within said shaft housing along a length of a reference axis defined by the SUP paddle shaft.

The plurality of interlocking fan blades of the second blade may be configured to move in a direction perpendicular to the reference axis. The plurality of interlocking fan blades includes a first set of fan blades and a second set of fan blades. The first set of fan blades move in a first plane along a −X axis direction that is perpendicular to the reference axis, and the second set of blades move, usually simultaneous with the first set of fan blades, in the first plane along a +X axis direction that is perpendicular to the reference axis.

When both the first set and second set of fan blades are moved along the first plane, fanning the plurality of blades outwards in a direction perpendicular to the paddle shaft, a second paddle blade is provided along the shaft proximate to the handle end of the SUP paddle.

According to some embodiments, the second paddle blade may be locked in either expanded form, for kayak style paddling, or in compressed form for storage within the paddle shaft for standup style paddling.

According to some embodiments, the fan blades are reinforced to ensure the second paddle blade can withstand the same strong forces from vigorous paddling as can the first, fixed, paddle blade.

According to embodiments illustrated herein, there may be provided a method for converting a standup paddle board (SUP) paddle into a kayak-style paddle, the method includes disengaging, using an unlocking mechanism, a plurality of interlocking fan blades housed in a housing structure incorporated into a shaft connecting a first blade disposed at a first end of the SUP paddle to a handle for gripping disposed at a second end of the SUP paddle. The housing structure houses the plurality of interlocking fan blades along a length of a reference axis defined by the length of the SUP paddle shaft. The plurality of interlocking fan blades may be configured to move in a direction perpendicular to the reference axis. The plurality of overlapping fan blades comprise a first set of fan blades and a second set of fan blades. The first set of fan blades move in a first plane along a −X axis direction that is perpendicular to the reference axis, at the same time as the second set of fan blades move in the first plane along a +X axis direction that is perpendicular to the reference axis, thereby providing a second, folding paddle blade along the shaft of the handle end of the SUP paddle for kayak style paddling.

One aspect of the SUP paddle of the subject invention is to provide a SUP paddle that is easily and quickly converted into a kayak-style paddle.

A further aspect of the SUP paddle of the subject invention is to provide a convertible paddle that can propel a personal flotation device in the form of a floating board, by way of example a paddle board or surf board, efficiently while, alternatively, standing on the board, sitting on the board, kneeling on the board, and/or lying on the board.

A further aspect of the SUP paddle of the present invention is to provide a paddle that has a fixed blade at one end and both a handle and folding blade at the other end.

A further aspect of the SUP paddle of the present invention is to provide a standup paddle board paddle that has a second, optional folding blade that is entirely housed within the paddle shaft when not in use.

Other objects, features, and advantages of the present invention will be explained in the following detailed description of the invention having reference to the appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
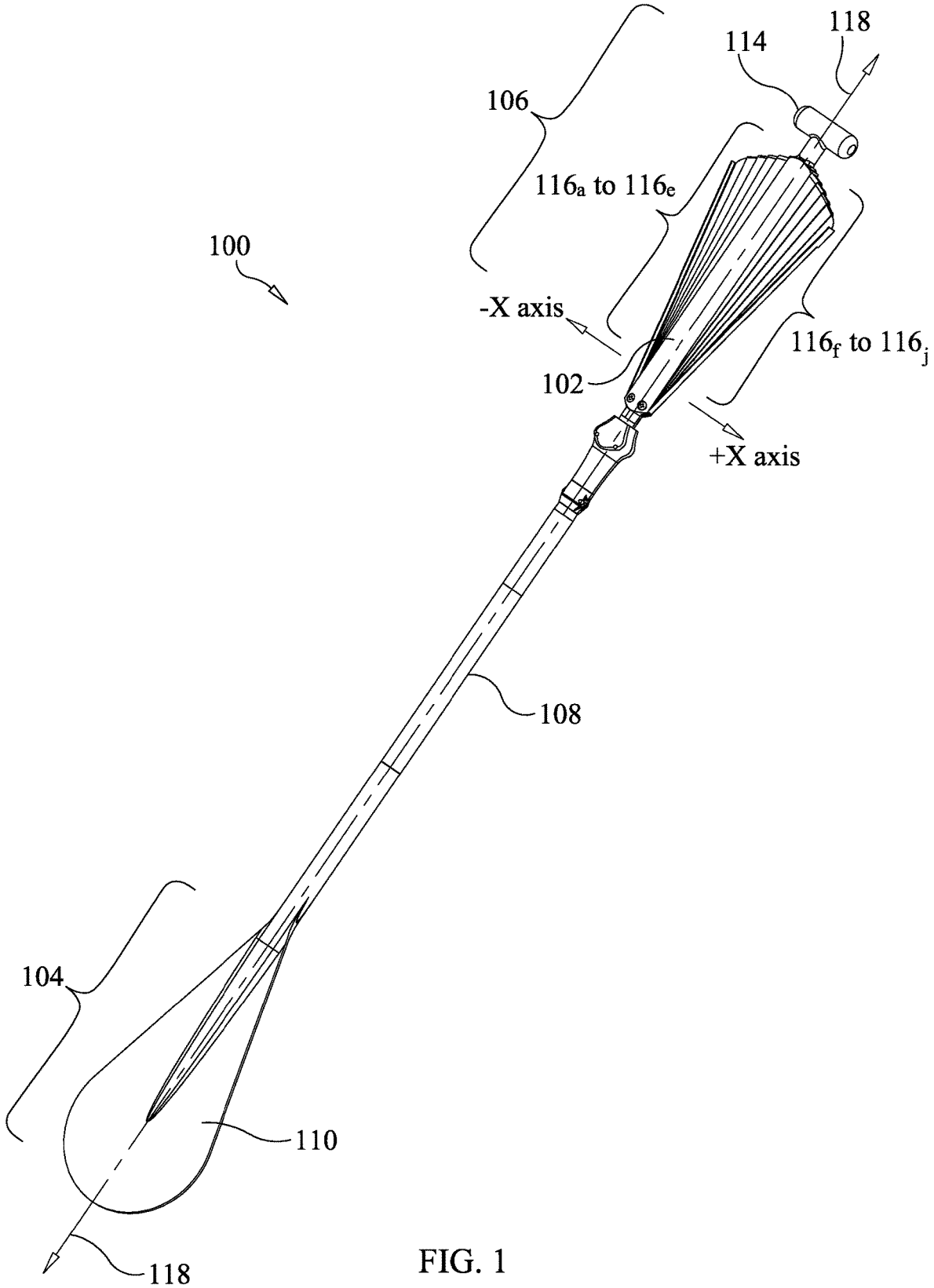
FIG. 1 is a top front perspective view of an exemplary standup paddle board (SUP) paddle exhibiting a first fixed blade and a second blade in an expanded position, to be used for kayak-style surfing in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

All of the implementations described below are exemplary implementations provided to enable persons skilled in the art to make or use the embodiments of the disclosure and are not intended to limit the scope of the disclosure, which is defined by the claims. For purposes of description herein, and unless a different interpretation is suggested or compelled by the context, the terms "top", "bottom", "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as directed by 35 U.S.C. § 112.

Various implementations may be found in a standup paddle board (SUP) paddle which may be converted to a kayak-style paddle. The SUP paddle of the present invention comprises a first paddle end. The first paddle end includes a first fixed blade. The SUP paddle further includes a second paddle end comprising a handle for gripping the SUP paddle. The SUP paddle further includes a paddle shaft extending from the first paddle end with fixed blade to the second paddle end with handle. The shaft proximate to the handle end incorporates a structure that houses a plurality of interlocking fan-blades that, when stored, are overlapped along a length of a reference axis defined by the length of the paddle shaft.

The plurality of interlocking fan blades may be configured to move in a direction perpendicular to the reference axis to form a second paddle blade. The plurality of fan blades interlock with one another and may be described to include a first set of fan-blades and a second set of fan-blades. The first set of fan-blades move in a first plane along a −X axis direction that is perpendicular to the reference axis, and the second set of fan-blades move, typically simultaneously with the first set, in the first plane along a +X axis direction that is perpendicular to the reference axis, thereby providing a second, folding blade that is housed within the handle end of the paddle shaft when not in use.

In an embodiment, the SUP paddle includes a locking mechanism to lock the position of the plurality of interlocking fan blades in one of an open or expanded position, or a closed or collapsed position. In an embodiment, the SUP paddle may be converted from a closed position into an expanded position, and vice versa. In order to achieve the expanded position, the first set of fan blades are moved outwards in the first plane along the −X axis direction that is perpendicular to the reference axis, while at the same time the second set of fan blades are moved outwards in the first plane along the +X axis direction that is perpendicular to the reference axis. Similarly, in order to achieve the closed position after the expanded position, the first set of fan blades are moved inwards in the first plane along the −X axis direction that is perpendicular to the reference axis, and simultaneously the second set of fan blades are moved inwards in the first plane along the +X axis direction that is perpendicular to the reference axis.

In an embodiment, the first fixed blade at the bottom of the paddle shaft extends outwards from the reference axis in an −X axis direction and +X axis direction along a second plane different from the first plane. In this case, the orientation of the first, fixed blade may be rotated 90 degrees relative to the orientation of the folding second blade when the second blade is in expanded format. In an alternative embodiment, the first plane and the second planes are the same. In this case, the orientation of the first, fixed blade is parallel relative to the orientation of the folding second blade when the second blade is in expanded format.

The SUP paddle with second folding blade in the closed position may be used for paddle surfing. The SUP paddle with second folding blade in the open position may be used for kayaking.

In an embodiment, the plurality of overlapping fan blades may be interlocked with each other for expanding or collapsing the plurality of overlapping blades in one of −X axis direction or +X axis direction that is perpendicular to the reference axis.

Further in accordance with an embodiment, the paddle shaft includes two plates disposed parallel to each other and spaced apart from each other with a pre-defined space. The pre-defined space may be utilized to house the plurality of overlapping fan blades along a length of a reference axis defined by the length of the paddle shaft.

In an embodiment, the SUP paddle may be used on a SUP that may include a floating body having a long midline axis, a bow end, a stern end, a top surface and a bottom surface.

In another implementation, there may be provided a method for converting a standup paddle board (SUP) paddle to a kayak-style paddle, the method includes disengaging, using an unlocking mechanism, a plurality of interlocking fan blades housed in a housing incorporated into the paddle shaft proximate to the handle end. The housing houses the plurality of interlocking fan blades along a length of a reference axis defined by the length of the paddle shaft. The plurality of interlocking fan blades may be configured to move in a direction perpendicular to the reference axis. The plurality of interlocking fan blades comprises a first set of fan blades and a second set of fan blades. The first set of fan blades move in a first plane along a −X axis direction that is perpendicular to the reference axis. The second set of fan blades move in the first plane along a +X axis direction that is perpendicular to the reference axis.

In an embodiment, the SUP paddle may be converted from a kayak-style paddle to SUP-style paddle by collapsing the interlocking fan blades into the housing and locking them therein using a locking mechanism. Collapsing the fan blades is performed by movement of the first set of fan blades moving in a first plane along a +X axis direction that is perpendicular to the reference axis, and the second set of fan blades moving in the first plane along a −X axis direction that is perpendicular to the reference axis.

In an embodiment, a user may sit on the SUP and utilizes the SUP paddle as a kayak paddle for kayak-style paddling. In an embodiment, the SUP paddle may be used on a SUP comprising a floating body having a long midline axis, a bow end, a stern end, a top surface and a bottom surface.

In an embodiment, the locking and the unlocking mechanism may be disposed along the shaft housing, and in particular, at the end of the shaft housing opposite the paddle handle.

In another embodiment, the locking and unlocking mechanism is a ring structure or cincture, disposed around the paddle shaft just below the second, folding blade. The ring is slid upwards towards the paddle handle to collapse the fan blades into the shaft housing, and the ring is slid downwards towards the first, fixed blade, to expand the fan blades away from the shaft housing.

In a further embodiment, the locking and unlocking mechanism is a collar that rotates around a groove made in the paddle shaft, just below the second folding blade. The ring is rotated in the groove in a first direction to unlock the fan blades, and slid upwards towards the paddle handle to collapse the fan blades into the shaft housing. The ring is rotated in the opposing direction to lock the fan blades inside the shaft housing.

The ring may then be rotated once again in a first direction to unlock the fan blades from the blade housing, slid downward away from the paddle handle to expand the blades from within the housing, and rotated in the opposing direction to lock the fan blades of the second paddle blade in expanded or open position.

In an embodiment, the locking/unlocking mechanism is configured to be in mechanical communication with the fan blades such that rotation of the locking/unlocking mechanism causes the fan blades to move outwards from the paddle shaft, or inwards towards the paddle shaft. In an embodiment, the locking/unlocking mechanism communicates with the outside or lead fan blades to cause the outside or lead fan blades to move outwards, or inwards, with each adjoining interlocked fan blade being moved together therewith.

In a further embodiment, the locking/unlocking mechanism is configured to be in mechanical communication with the fan blades such that rotation of the locking/unlocking mechanism locks the fan blades in either an expanded or collapsed format, and the sliding of the locking/unlocking mechanism either towards or away from the paddle handle to cause the fan blades to move outwards from the paddle shaft, or inwards towards the paddle shaft. In an embodiment, sliding the locking/unlocking mechanism communicates with the outside or lead fan blades to cause the outside or lead fan blades to move outwards, or inwards, with each adjoining interlocked fan blade being moved concurrently therewith.

According to a further embodiment of the present invention, reinforcing tabs are added to the base and/or ends of the fan blades to provide the overlapping fan blades with additional strength and stiffness to withstand the forces encountered during vigorous paddling.

According to a further embodiment, reinforcing struts are added to the outside edge of the lead fan blades to provide the lead fan blades with additional strength and stiffness to withstand the forces encountered during vigorous paddling.

In an embodiment, grooves and knobs are formed within the fan blades for interlocking the fan blades and ensuring the fan blades do not expand too far, or separate, one from the other.

According to another embodiment, the paddle shaft is made expandable and/or rotatable using a spring-loaded button that fits into a plurality of holes formed along the length of the paddle shaft. Because the handle end of the shaft incorporates the second, folding blade, the shaft may be made expandable, or rotatable, at a point along the shaft between the folding blade housing and the fixed blade.

In another embodiment, the shaft comprises one or more lengths that are detachable and re-attachable for easy stowage.

FIG. 1 illustrates in perspective, from the top front, an exemplary standup paddle board (SUP) paddle having a first fixed blade and a second, folding blade shown here in expanded/open position to be used for kayak-style surfing, in accordance with an embodiment of the present invention.

With reference to FIG. 1, there is shown a convertible SUP paddle 100 of the subject invention. An example standup paddle board (not shown) may include a floating body having a long midline axis, a bow end, a stern end, a top surface, and a bottom surface. The top region of the floating body may comprise a slip resistant material, which may extend from the bow end to the stern end. The SUP may further include a deck region located on the top surface on which a user may stand to operate the SUP using the SUP paddle 100.

In an implementation, the SUP paddle 100 may include a first paddle end 104 and a second paddle end 106. The SUP paddle 100 may further include a shaft 108 that connects the first paddle end 104 and the second paddle end 106. The first paddle end 104 may include a first fixed blade 110. The second paddle end 106 may include a handle 114 for gripping the SUP paddle 100. The shaft 108 may connect the fixed blade 110 to the handle 114 of the SUP paddle 100.

In an implementation, the shaft 108 including a housing 102 to store a plurality of overlapping/interlocking fan blades 116 along a length of a reference axis 118 defined by the length of shaft 108. A person of ordinary skill in the art will appreciate that the reference axis 118 may be an imaginary reference line included in the drawings for illustrative purposes.

The plurality of interlocking fan blades 116 may be configured to move in a direction perpendicular to the reference axis 118. According to the embodiment illustrated in FIG. 1, the plurality of interlocking fan blades 116 includes a first set of five fan blades **116*a* to 116*e* and a second set of five fan blades 116*f* to 116*j*. The first set of fan blades 116*a* to 116*e* move in a first plane along a −X axis direction that is perpendicular to the reference axis 118. The second set of fan blades 116*f* to 116*j* move in the first plane along a +X axis direction that is perpendicular to the reference axis 118, for example, an exemplary plane created between the length of the reference axis 118** and the −X and +X axes.

In an embodiment, the first fixed blade 110 may extend outwards from the reference axis 118 in the −X axis and +X axis along a second plane. In an embodiment, the first plane (of folding blade 116) and the second plane (of fixed blade 110) may be the same, as illustrated in FIG. 1. In this case, the angle formed between the two planes is 0-degrees and the first fixed blade 110 will extend out from shaft 108 at the same angle as the second folding blade 116 when blade 116 is in expanded format. In another embodiment (not shown), the first and the second plane may be offset by a pre-defined angle, such that a non-zero angle created between the planes. In an embodiment (not shown), the first fixed blade 110 will extend out from shaft 108 at an angle that is 90 degrees different from the angle exhibited by the second folding blade 116 when blade 116 is in expanded format.

In an embodiment, the SUP paddle 100 includes a locking mechanism to lock the position of the plurality of interlocking fan blades 116 in one of an expanded position or a collapsed (closed) position. In an embodiment, the SUP paddle 100 may be converted from a closed position into an expanded position, and vice versa. In order to achieve the open position, the first set of fan blades **116*a* to 116*e* are moved outwards in the first plane along the −X axis direction that is perpendicular to the reference axis 118, while the second set of fan blades 116*f* to 116*j* are moved outwards in the first plane along the +X axis direction that is perpendicular to the reference axis 118. Similarly, in order to achieve the closed position after the expanded position, the first set of fan blades 116*a* to 116*e* are moved inwards in the first plane along the −X axis direction that is perpendicular to the reference axis 118, while the second set of fan blades 116*f* to 116*j* moved inwards in the first plane along the +X axis direction that is perpendicular to the reference axis 118**.

In an embodiment, the plurality of overlapping fan blades 116 may be interlocked with each other for expanding or collapsing the plurality of interlocking fan blades 116 in one of −X axis direction or +X axis direction that is perpendicular to the reference axis 118.

Incorporated into shaft 108 of paddle 100 is a blade housing 102 that forms a portion of shaft 108 and that is used to enclose and store folding blades 116 when folding blades 116 are in compressed or closed format.

In an implementation, the SUP paddle 100 with the plurality of overlapping/interlocking blades 116 disengaged to extend outwards from shaft 108, may be used for kayaking. Further, the SUP paddle 100, with the plurality of interlocking blades 116 interlocked in collapsed position and housed within housing 102 (as depicted in FIG. 2), may be used for SUP surfing.

Figure 2:
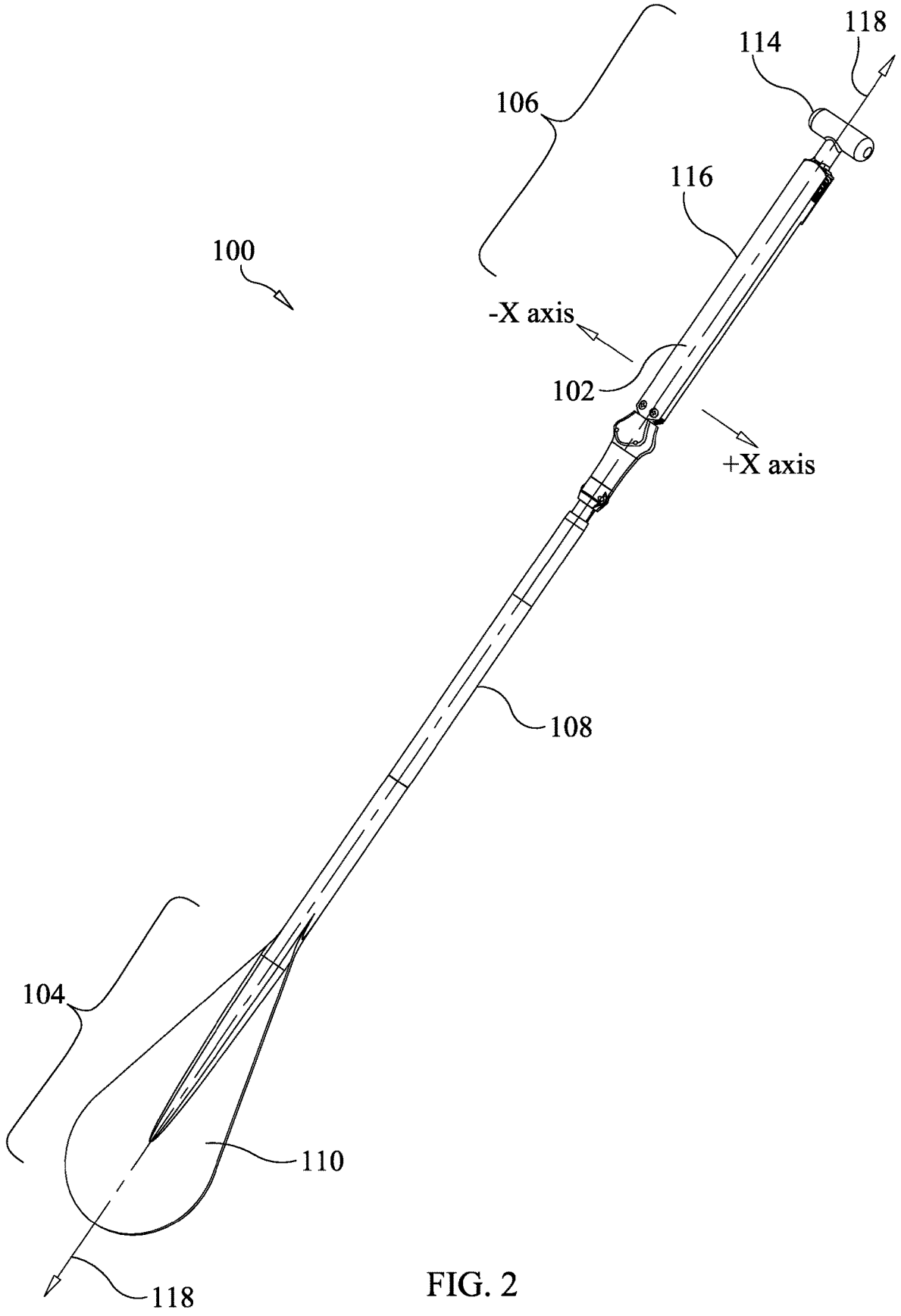
FIG. 2 is a top front perspective view of the exemplary standup paddle board (SUP) paddle exhibiting a first fixed blade with the second blade in a collapsed position, to be used for SUP paddle style surfing in accordance with an embodiment of the present invention.

FIG. 2 illustrates in perspective, from the top front, an exemplary standup paddle board (SUP) paddle of the subject invention with second folding blade 116 in a collapsed position within housing 102 to be used for SUP style surfing in accordance with an embodiment of the present invention. Elements of FIG. 2 have been explained in conjunction with the elements of FIG. 1. As is depicted in FIG. 2, the plurality of interlocked fan blades 116 are collapsed and housed inside housing structure 102 incorporated into shaft 108. In the depicted configuration, the SUP paddle may be used for SUP surfing.

Figure 3A:
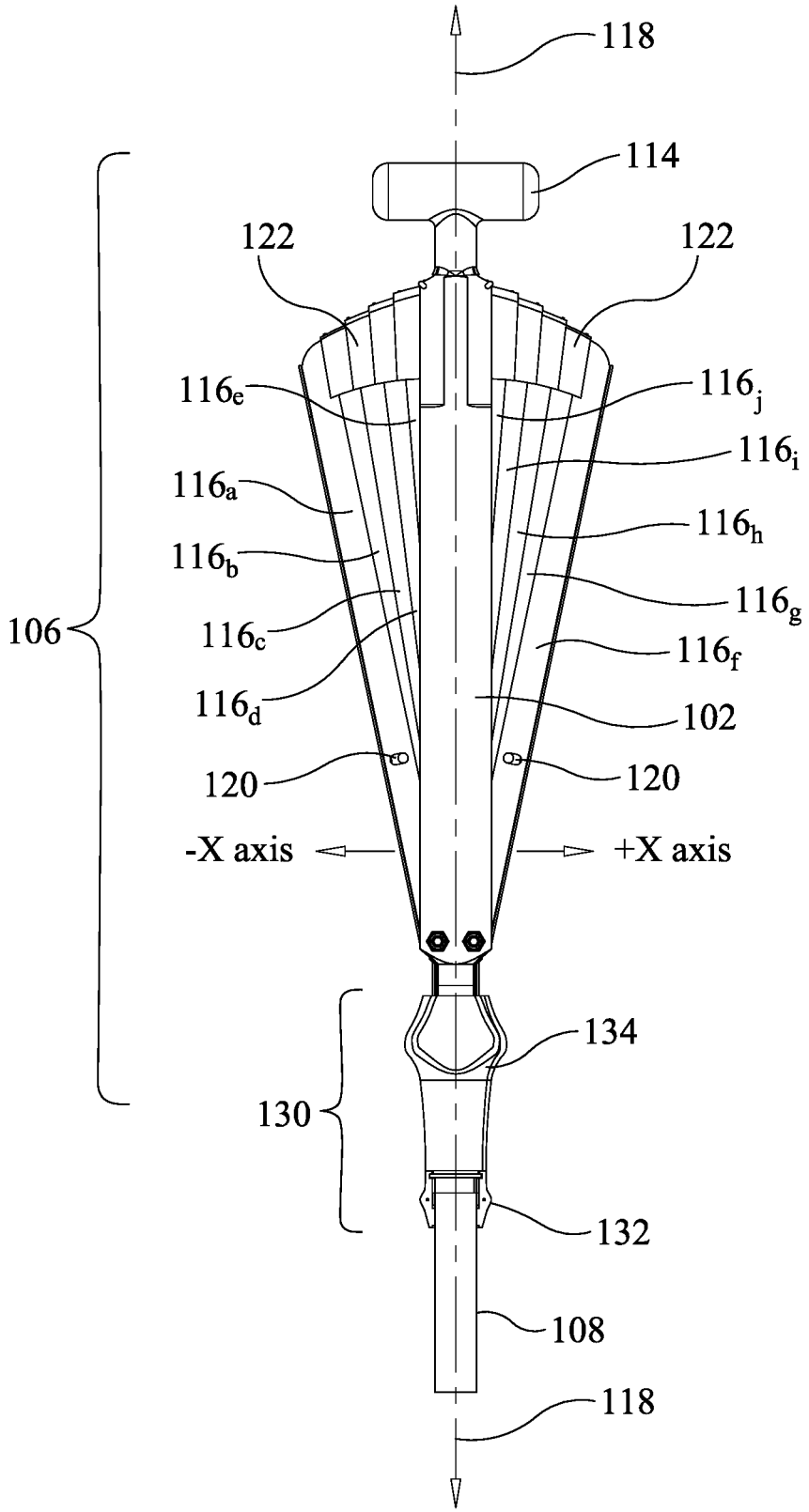
FIG. 3A illustrates from the rear an exemplary handle end of the SUP paddle exhibiting a second blade comprised of interlocking fan blades, in expanded format.

FIG. 3A is a rear view of the handle end of an exemplary standup paddle board (SUP) paddle having interlocking fan blades in an expanded position, in accordance with an embodiment of the present invention. Elements of FIG. 3A have been explained in conjunction with the elements of FIG. 1.

With reference to FIG. 3A, there is shown second paddle end 106 of the SUP paddle 100. Second paddle end 106 includes handle 114 for gripping the SUP paddle 100. The shaft 108 connects the fixed blade 110 (shown in FIGS. 1 and 2) to the handle 114 of SUP paddle 100. FIG. 3A further depicts the imaginary reference axis 118 axially defined by the length of shaft 108.

The SUP paddle 100 depicted in FIG. 3A exhibits a state where the plurality of interlocking fan blades 116 are in an expanded form such that the SUP paddle is ready to be used as kayak style paddle. As depicted, the plurality of interlocking fan blades 116 include a lead interlocking fan blade 116*a* configured to move axially outwards from shaft 108 in the direction of −X axis and a lead interlocking fan blade 116*f* configured to move axially outwards from shaft 108 in the direction of +X axis. Lead interlocking fan blade 116*a* and lead interlocking fan blade 116*f* may further include tangs along their outward edges for strength and rigidity.

The plurality of interlocking fan blades 116 further include an interlocking follow fan blade 116*b* configured to move axially outwards from shaft 108 in the direction of −X axis and an interlocking follow fan blade 116*g* configured to move axially outwards from shaft 108 in the direction of +X axis.

The plurality of interlocking fan blades 116 further include an interlocking follow fan blade 116*c* configured to move axially outwards from shaft 108 in the direction of −X axis and an interlocking follow fan blade 116*h* of configured to move axially outwards from shaft 108 in the direction of +X axis.

The plurality of interlocking fan blades 116 further include an interlocking follow fan blade 116*d* of configured to move axially outwards from shaft 108 in the direction of −X axis and an interlocking follow fan blade 116*i* of configured to move axially outwards from shaft 108 in the direction of +X axis.

The plurality of interlocking fan blades 116 further include an interlocking follow fan blade 116*e* of configured to move axially outwards from shaft 108 in the direction of −X axis and an interlocking follow fan blade 116*j* configured to move axially outwards from shaft 108 in the direction of +X axis.

The lead interlocking fan blade 116*a* and lead interlocking fan blade 116*f* may each further include a guide 120 comprising a slot that accommodates knobs formed on follow fan blades 116 to prevent fan blades 116 from overextending and separating one from the other while in expanded format, and to ensure that fan blades 116 to move in unison when a force is applied to an individual fan blade 116.

Also in accordance with the embodiment illustrated in FIG. 3A, the top portions of fan blades 116, or some of them, are reinforced by tabs 122 to provide folding blade 116 with additional stiffness and strength for vigorous paddling.

FIG. 3A also illustrates a lock mechanism 130 extending from the base of folding blade housing 102, used to expand, contract and lock folding blade 116.

Figure 3B:
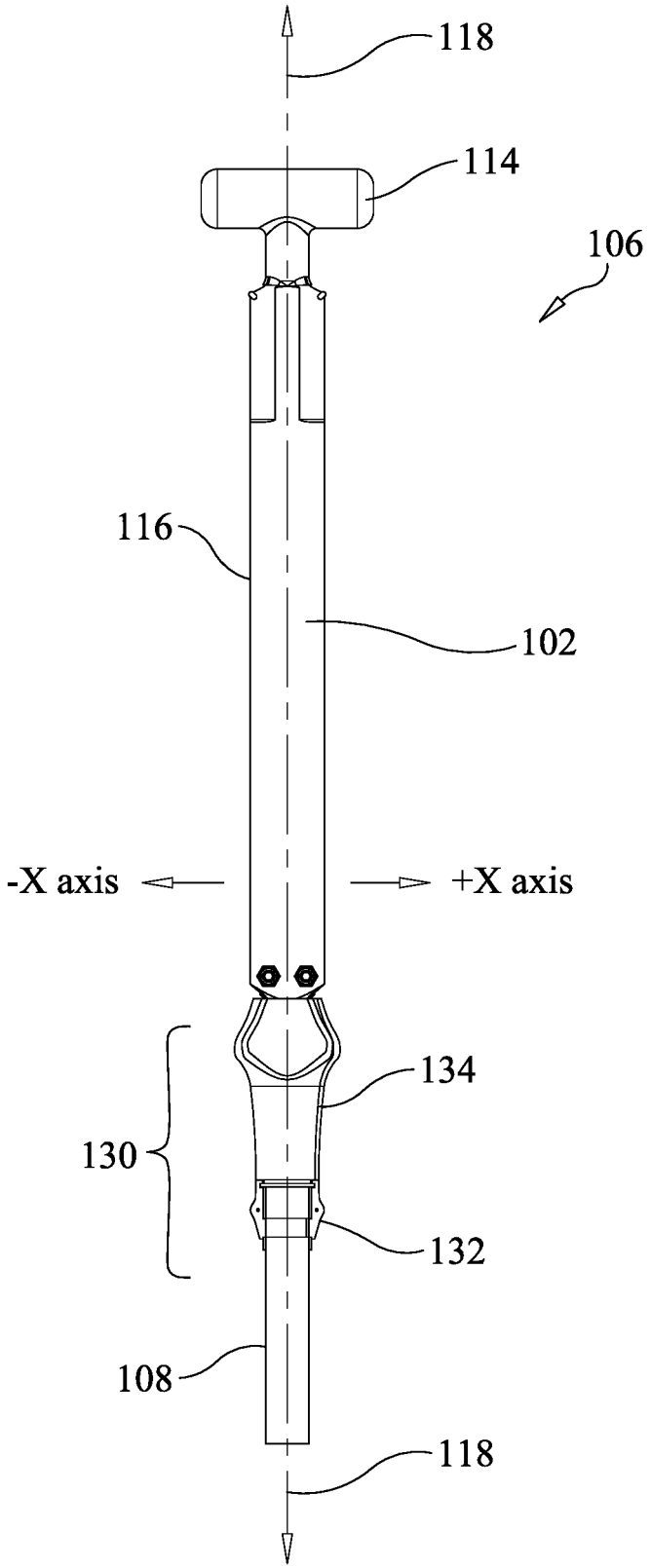
FIG. 3B illustrates from the rear the exemplary handle end of the SUP paddle exhibiting a second blade comprised of interlocking fan blades, in collapsed format.

In accordance with the lock mechanism 130 shown in FIG. 3A, lock mechanism 130 comprises a lock collar 132 (shown as a half collar in FIGS. 3A and 3B for illustrative purposes) and communicating flanges 134. Lock collar 132 is rotated in one direction to unlock, and then slid down together with flanges 134 away from housing 102 and handle 114 to expend fan blades 116. Lock collar 132 may then be rotated in the opposite direction to lock folding blade 116 in expanded format as shown in FIG. 3A. Conversely, lock collar 132 is rotated to unlock folding blades 116, and slid up together with flanges 134 towards housing 102 and handle 114 to collapse blades 116 into housing 102, and collar 132 is then rotated again in the opposing direction to lock folding blade 116 within housing 102 (as shown in FIG. 3B).

According to the lock mechanism embodiment shown in FIG. 3A, communicating flanges 134 communicate in mechanical fashion the sliding force of lock collar 132 and to lead fan blades 116*a* and 116*f* by way of grooves and tabs (not visible) incorporated into flanges 134 and lead blades 116*a* and 116*f*. In one embodiment, sliding collar 132 upwards towards handle 114 causes flanges 134 to pull lead fan blades 116*a* and 116*f* inwards into blade housing 102, while sliding collar 132 downwards away from handle 114 causes flanges 134 to spread lead fan blades 116*a* and 116*f* outwards from within housing 102.

In an embodiment, there is a groove on shaft 108 below where collar 132 sits, shown in FIGS. 3A and 3B, that interacts with a tab on the inside surface of collar 132 (not shown) that facilitates the locking of folding blades 116 after rotation of collar 132 around shaft 108.

Meanwhile, fan blade guide 120 ensures that follow fan blades 116*b* through 116*e* and 116*g* through 116*j* move together with lead blades 116*a* and 116*j* when blades 116 are being spread away from blade housing 102 or pulled into blade housing 102.

FIG. 3A shows lock mechanism 130 slid downward away from housing 102 with fan blades 116 locked in expanded format for kayak style paddling.

While fan blades 116 illustrated in FIGS. 1 and 3A comprise a first set of five fan blades 116*a* through 116*e*, and a second set of five fan blades 116*f* through 1116*j*, it will be appreciated by those skilled in the art that there will be other embodiments of the subject invention wherein the first and second set of fan blades 116 comprise more than five, or less than five, interlocking fan blades, and/or that the size and shape of the fan blades on each side may be varied, with the goal of providing a folding blade that extends from either side of shaft 108 providing equivalent surface areas when expanded such that the force produced on either side of the shaft 108 when paddling paddle 100 through the water is roughly equal.

It will be similarly appreciated by those skilled in the art that guide 120, reinforcing tabs 122, and lock mechanism 130 can take on different forms and formats, and be configured differently with respect to fan blades 116, without departing from the scope or spirit of the subject invention.

FIG. 3B illustrates in rear view the second paddle end 106, being the handle portion, of an exemplary standup paddle board (SUP) paddle having interlocking fan blades in a closed or collapsed position, in accordance with an embodiment of the present invention. Elements of FIG. 3A have been explained in conjunction with the elements of FIGS. 1 to 3A.

With reference to FIG. 3B, second paddle end 106 of the SUP paddle 100 demonstrates a state where the plurality of interlocking fan blades 116 have been collapsed (closed) for storage within housing 102. Such an operation is performed by movement of the interlocking fan blades 116*f* to 116*j* (shown in FIG. 3A) in the direction of +X axis and movement of the interlocking fan blades 116*a* to 116*e* (shown in FIG. 3A) in the direction of −X axis. Once in a closed state, the SUP paddle may be used as SUP paddle for paddling using the first fixed blade 110 provided at the first paddle end 104 (shown in FIGS. 1 and 2) and gripping the SUP paddle 100 using the handle 114 while paddling.

FIG. 3B shows lock mechanism 130 slid upwards towards housing 102 with fan blades 116 locked within housing 102 in collapsed format for SUP style paddling.

Importantly, as shown in FIG. 3B, no portion of the folding blade 116 extends beyond blade housing 102. That folding blade 116 is entirely enclosed within housing 102 ensures that paddle 100 may be used for standup paddling without obstruction or impediment, and with the same ease and convenience as with a conventional SUP paddle.

Figure 4A:
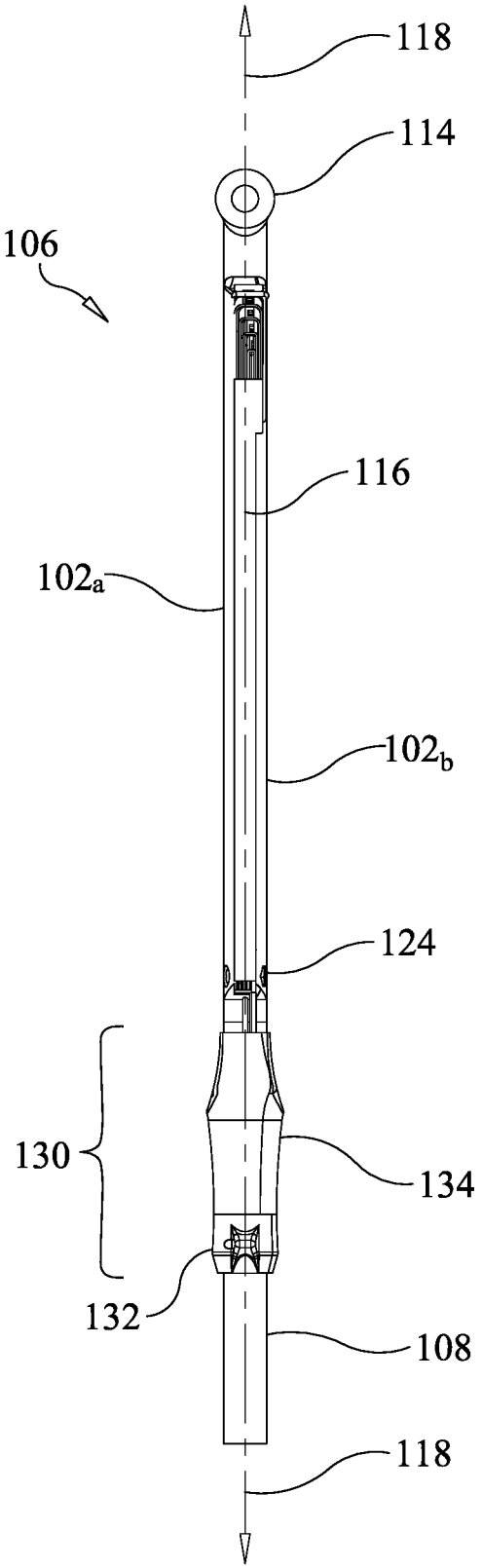
FIG. 4A is a left-side view of an exemplary handle end of the SUP paddle, with interlocking fan blades in expanded position, the right-side view being a mirror image thereof.

FIG. 4A is a left-side view of the handle portion of an exemplary standup paddle board (SUP) paddle with folding second blade in an expanded format, in accordance with an embodiment of the present invention. Elements of FIG. 4A have been explained in conjunction with the elements of FIGS. 1 to 3B.

With reference to FIG. 4A, second paddle end 106 of the SUP paddle 100 includes folding blade housing 102 comprising two plates, 102*a* and 102*b*, each parallel to one another forming a portion of shaft 108 proximate to handle 114. Plates 102*a* and 102*b* also define a space utilized to house the plurality of interlocking fan blades 116 along a length of a reference axis 118 passing along the length of the SUP paddle 100.

Housing 102 has a base extending away from handle 114. Folding fan blades 116 are stored within housing 102 and affixed to shaft 108 at the base of housing 102 using, in this case, blade screws 124.

Formed along shaft 108 proximate to the base of housing 102 is lock mechanism 130 comprising lock collar 132 and communicating flanges 134. As explained with reference to FIGS. 3A and 3B, collar 132 can be rotated, for example 90 degrees, to unlock folding blades 116. Collar 132 with flanges 134 can then be slid away from housing 102 as shown in FIG. 4A to expand fan blades 116 outward from within housing 102. Collar 132 is then rotated back, for example a quarter turn, to lock fan blades 116 in the expanded format shown.

Figure 4B:
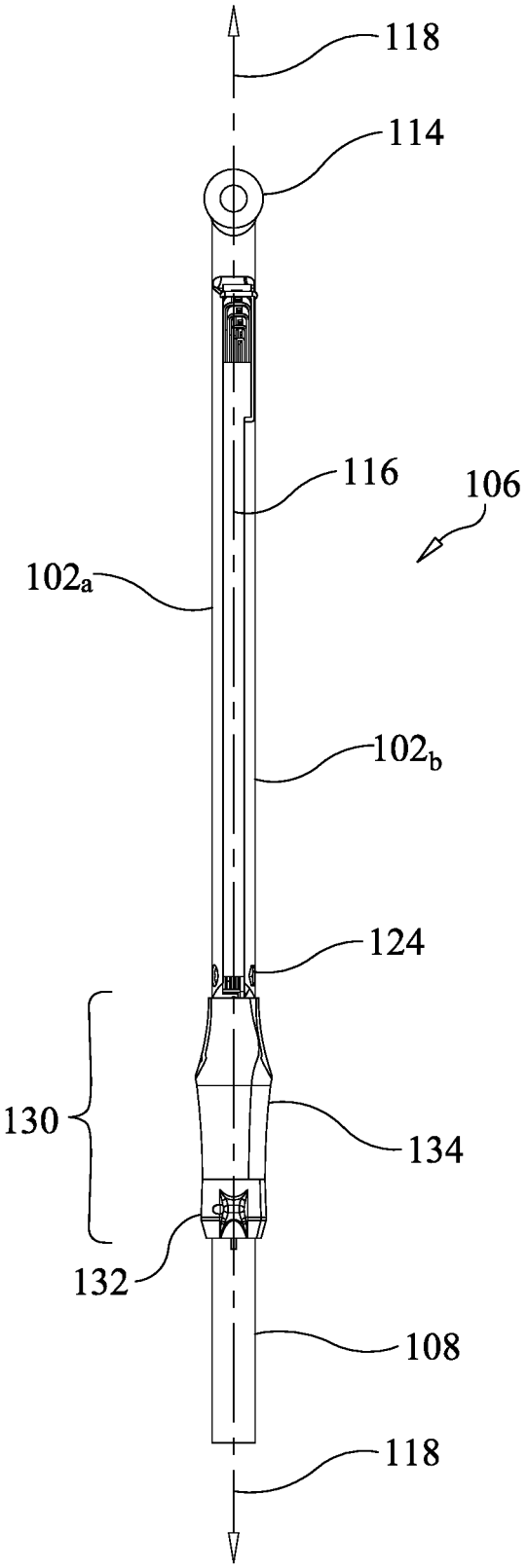
FIG. 4B is a left-side view of the exemplary handle end of the SUP paddle, with interlocking blades in collapsed position, the right-side view being a mirror image thereof.

Collar 132 can then be rotated again, to unlock fan blades 116, and then slid upwards together with flanges 134, towards handle 114, to collapse fan blades 116 inward for storage within housing 102 (as shown in FIG. 4B). Collar 132 is then rotated the opposite direction in order to lock fan blades 116 within blade housing 102 in the collapsed format shown in FIG. 4B.

Also in an embodiment, there are tabs between communicating flanges 134 and shaft 108, not shown, that communicate with the lead fan blades 116*a* and 116*f* to, alternatively, expand and contract lead fan blades 116*a* and 116*f* when lock mechanism 130 is rotated and slid upwards or downwards along shaft 108.

FIG. 4B is a left-side view of the handle portion of an exemplary standup paddle board (SUP) paddle with the second folding blade in closed or collapsed position, in accordance with an embodiment of the present invention. Elements of FIG. 4B have been explained in conjunction with the elements of FIGS. 1 to 4A.

With reference to FIG. 4B, second paddle end 106 of the SUP paddle 100 is shown in a state where the plurality of overlapping/interlocking fan blades 116 have been collapsed (closed) within housing 102 formed by plates 102*a* and 102*b*. To collapse (close) the plurality of interlocking fan blades 116 such that they are housed and locked back within housing 102, fan blades 116 may be pushed in the direction of −X axis and +X axis by sliding and rotating lock mechanism 130 as explained with reference to FIGS. 3A through 4A. Once fan blades 116 are in a closed state and locked entirely within housing 102, the SUP paddle 100 may be used as SUP paddle for paddling using the first fixed blade 110 provided at the first paddle end 104 and gripping the SUP paddle 102 using the handle 114 while paddling.

Figure 5B:
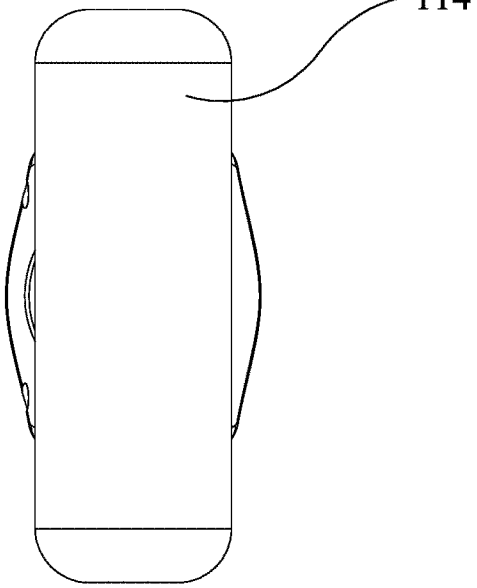
FIG. 5B illustrates from the top the exemplary handle end of the SUP paddle with a second blade in closed position.
Figure 5A:
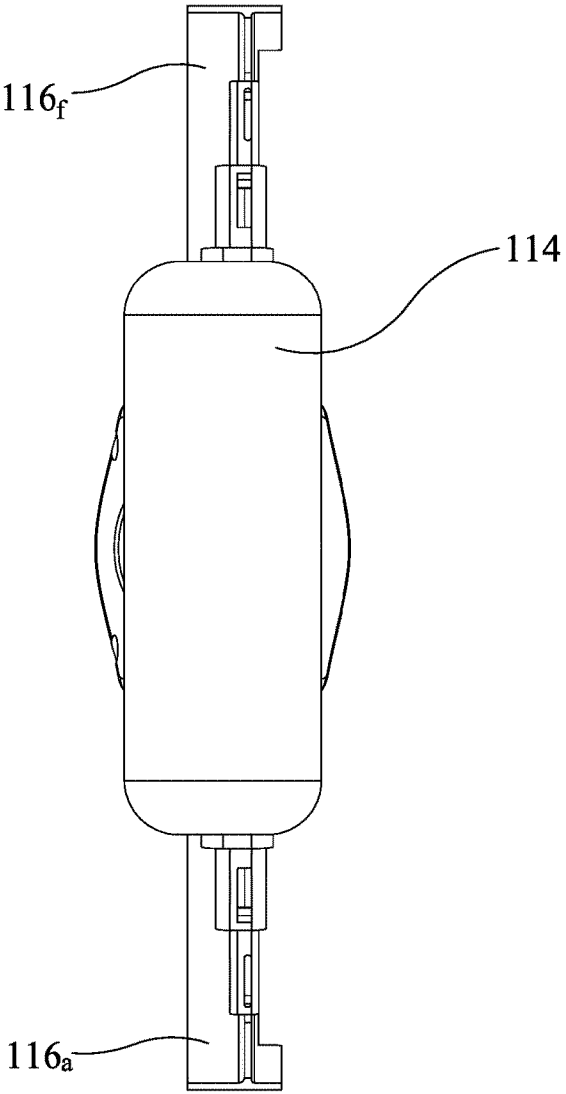
FIG. 5A illustrates from the top an exemplary handle end of the SUP paddle with a second blade in open position, in accordance with an embodiment of the present invention.

FIG. 5A illustrates from the top the handle portion of an exemplary standup paddle board (SUP) paddle with the second folding blade in expanded format, in accordance with an embodiment of the present invention, while FIG. 5B illustrates from the top the handle portion of an exemplary standup paddle board (SUP) paddle with the second folding blade in folded, stored format, in accordance with an embodiment of the present invention. Elements of FIGS. 5A and 5B have been explained in conjunction with the elements of FIGS. 1 to 4B.

With reference to FIG. 5A, SUP paddle 100 that includes the plurality of interlocking fan blades 116 with lead fan blade 116*a* extending from one side and lead fan blade 116*f* extending from the other. With reference to FIG. 5B, the plurality of interlocking fan blades 116 are stored within shaft 108 and, as such, are not visible in this view.

Figure 6A:
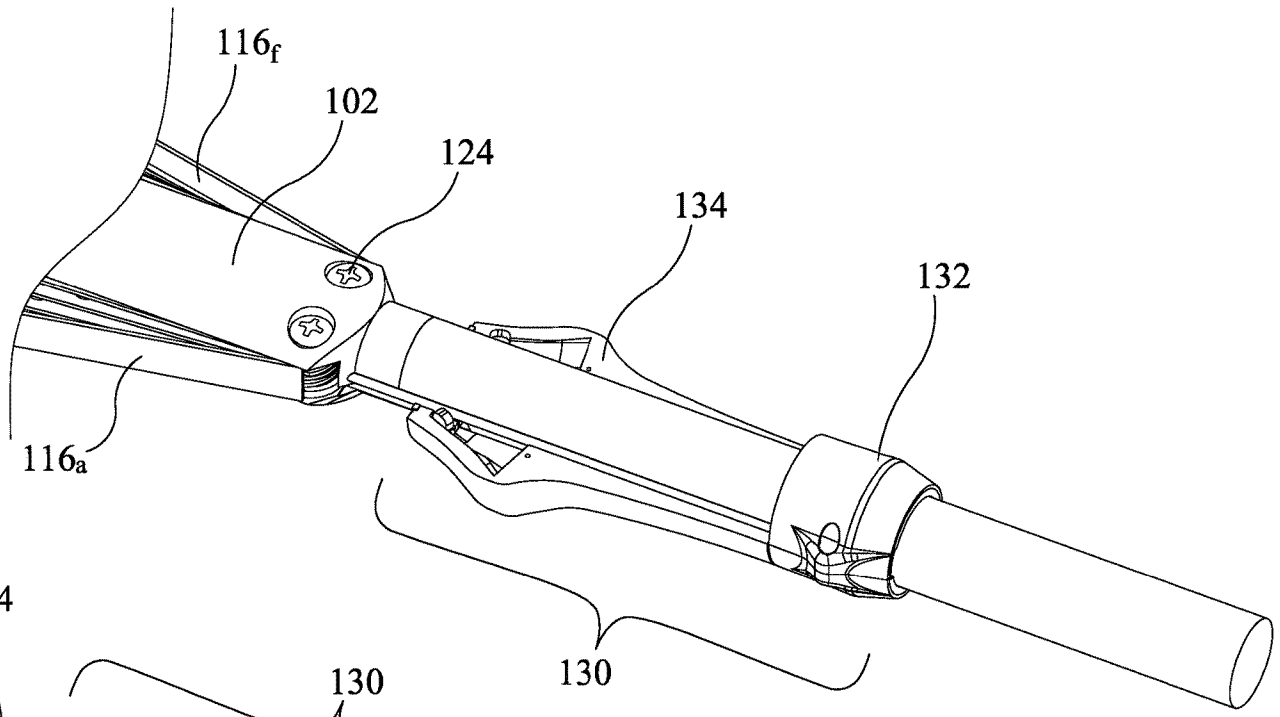
FIG. 6A is a bottom left front perspective view of an exemplary handle end shaft portion of the SUP paddle, showing a locking mechanism with the second blade locked in expanded position, in accordance with an embodiment of the present invention.
Figure 6B:
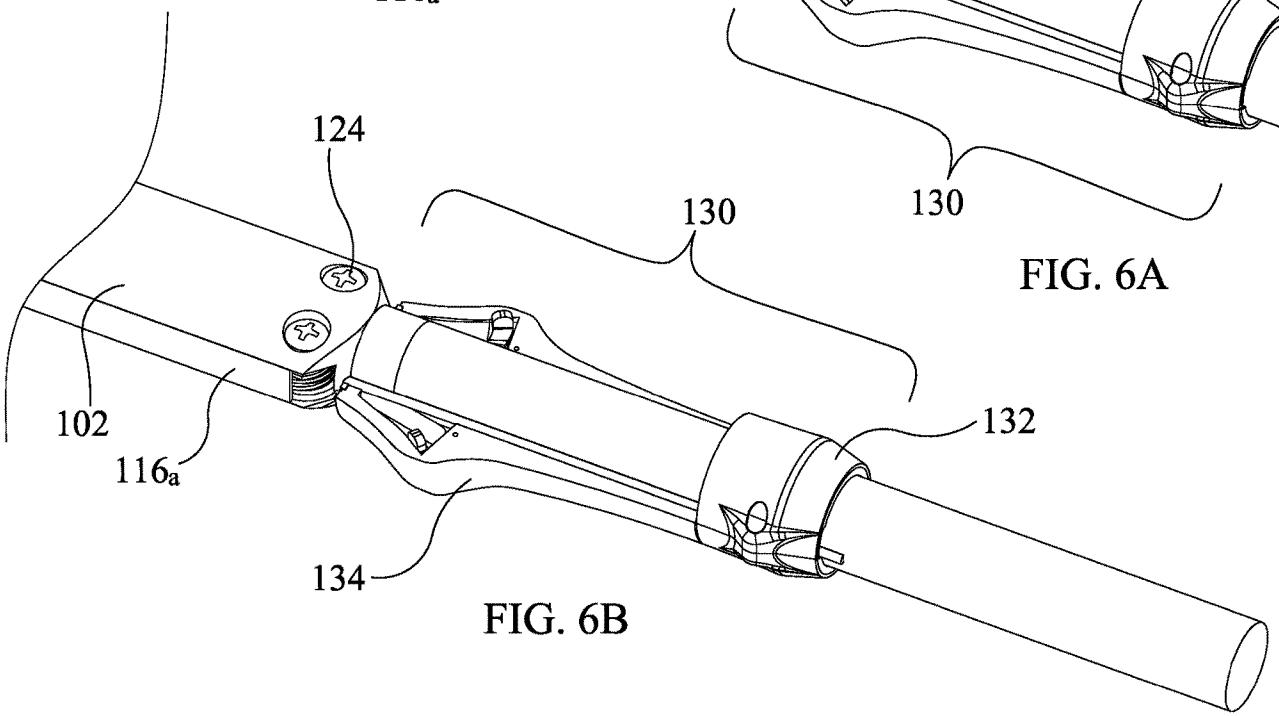
FIG. 6B is a bottom left front perspective view of the exemplary handle end shaft portion of the SUP paddle showing the locking mechanism with the second blade locked in closed position in accordance with an embodiment of the present invention.

FIGS. 6A and 6B show, from the bottom left front, an exemplary handle end shaft portion of the SUP paddle of the subject invention, showing the locking mechanism 130 slid down to lock folding paddle 116 in expanded position in FIG. 6A, and slid up to lock folding paddle 116 inside housing 102 in FIG. 6B. Screws 124 secure fan blades 116 within housing 102.

Figure 7A:
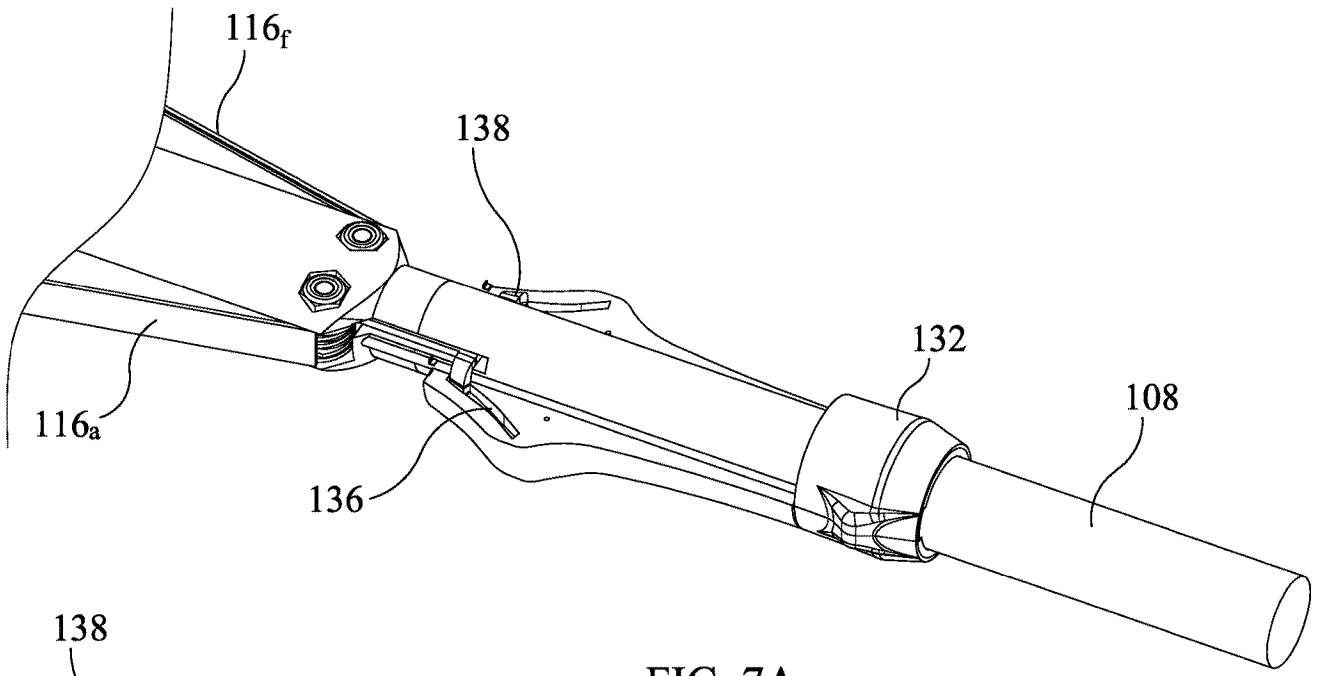
FIG. 7A is a bottom right rear perspective view of an exemplary handle end shaft portion of the SUP paddle, showing a locking mechanism with the second blade locked in expanded position, in accordance with an embodiment of the present invention.
Figure 7B:
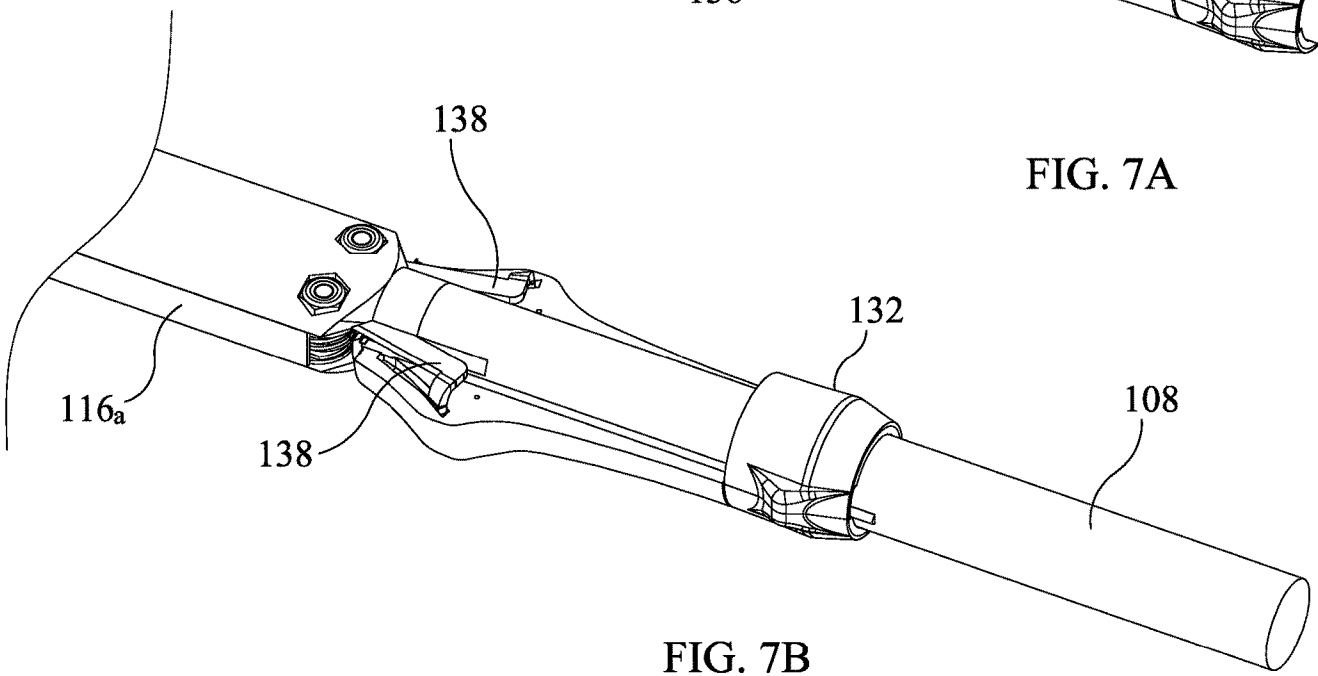
FIG. 7B is a bottom right rear perspective view of the exemplary handle end shaft portion of the SUP paddle showing a locking mechanism with the second blade locked in closed position in accordance with an embodiment of the present invention.

FIGS. 7A and 7B illustrate in perspective, from the bottom right rear, the exemplary handle end shaft portion of the SUP paddle of the subject invention, showing the locking mechanism 130 slid down to lock folding paddle 116 in expanded position in FIG. 7A, and slid up to lock folding paddle 116 inside housing 102 in FIG. 7B. The communicating flanges 134 shown in FIGS. 7A and 7B include flange grooves 136 that accommodate flange tabs 138. In accordance with the embodiment illustrated, flange tabs 138 communicate mechanically with lead fan blades 116*a* and 116*f* through tabs and grooves incorporated inside shaft 108 to, alternatively, pull lead fan blades 116*a* and 116*f* outward from within housing 102 so that paddle 100 can be used as a kayak style paddle, or inward towards housing 102 so that paddle 100 can be used as a SUP style paddle.

Figure 8:
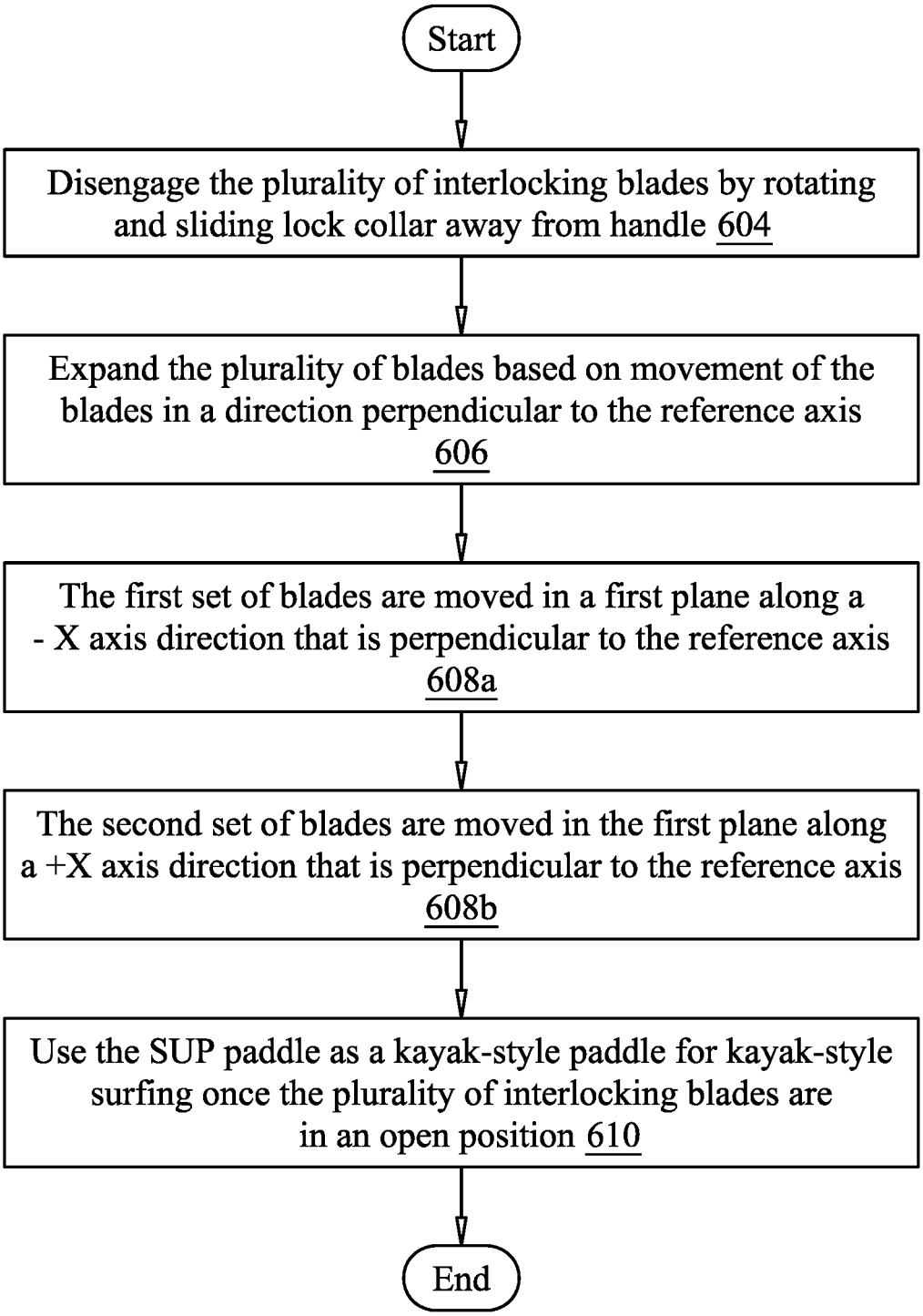
FIG. 8 illustrates using a flow chart a method of or converting a standup paddle board (SUP) paddle into a kayak-style paddle for kayak-style surfing, in accordance with an embodiment of the present invention.

FIG. 8 illustrates in flowchart form a method for converting a standup paddle board (SUP) paddle into a kayak-style paddle for kayak-style surfing or paddling, in accordance with an embodiment of the present invention. The method starts with the folding blade 116 in collapsed form within the paddle shaft.

At step 604, the plurality of overlapping/interlocking fan blades 116 may be disengaged by rotating and sliding lock collar 132 away from handle 114. In an embodiment, the plurality of interlocking fan blades may be housed in a housing structure incorporated into a shaft extending from a first fixed blade disposed at a first end of the SUP paddle to a handle for gripping disposed at a second end of the SUP paddle. The housing structure houses the plurality of overlapping/interlocking fan blades along a length of a reference axis defined by length of the paddle shaft.

At step 606, the plurality of interlocking fan blades may move in a direction perpendicular to the reference axis. At step 608*a*, a first set of fan blades may move in a first plane along a −X axis direction that is perpendicular to the reference axis. Simultaneously at step 608*b*, a second set of fan blades may move in the first plane along a +X axis direction that is perpendicular to the reference axis. At step 610, once the plurality of interlocking fan blades 116 are locked in an expanded format, the SUP paddle may be used as a kayak-style paddle for kayak-style surfing.

SUMMARY AND SCOPE

The convertible SUP paddle described and illustrated herein helps a beginner user to utilize the SUP paddle for SUP board paddling as well as to perform kayak-style paddling. Particularly, during bad weather conditions, the user may switch the SUP paddle to a kayak-style paddle in order to continue paddling more safely while sitting, kneeling or lying on the board. Thus, the claimed enhanced SUP paddle may help a user to easily navigate on the water during bad weather conditions and when the user is tired after standing for a long time on the SUP board.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

A person with ordinary skills in the art will appreciate that the systems, modules, and sub-modules have been illustrated and explained to serve as examples and should not be considered limiting in any manner. It will be further appreciated that the variants of the above disclosed system elements, modules, and other features and functions, or alternatives thereof, may be combined to create other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules, and are not limited to any particular process, system modules, modes of implementation and the like.

By way of example and not limitation, although locking mechanisms are disclosed, those skilled in the art will appreciate that other locking mechanisms, to lock the second folding blade in alternatively expanded or collapsed formats, may be employed in the present invention without departing from its spirit and/or scope. Similarly, methods for mechanically contracting and expanding the folding blades may be substituted for the illustrated method wherein a cincture or collar communicates mechanically with lead fan blades which, in turn, communicate mechanically with adjacent fan blades. Similarly, the fan blades can take on different shapes and sizes, may overlap to a greater or lesser extent, may interlock in a variety of manners, and may be reinforced and stiffened in a variety of manners not specifically illustrated herein.

In addition, a wide variety of safety features can be incorporated into the convertible SUP paddle described herein. For example, reflectors, waterproof LED lights, or other manners of illumination can be incorporated into the paddle shaft, second folding blade and/or handle of the convertible paddle. All such modifications are deemed to be within the scope and spirit of the subject invention.

The convertible SUP paddle blade of the present invention may be used, not only with SUP boards, but with all variety of personal water craft including, by way of example, surfboards, paddle boards, canoes, kayaks, small row boat, sailboats and power boats.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiments disclosed, but that the present disclosure will include all embodiments falling within the scope of the appended claims.

What is claimed is:

1. A convertible standup paddle board (SUP) paddle, comprising:

a fixed blade;

a handle for gripping;

a shaft connecting the fixed blade to the handle for gripping;

a housing incorporating into said shaft proximate to said handle;

a second, folding blade housed within said housing;

wherein the housing for the second folding blade comprises two plates disposed parallel to each other and spaced apart from each other with a pre-defined space to receive and store the folding blades along a length of a reference axis defined by the length of the paddle shaft.

2. A convertible standup paddle board (SUP) paddle, comprising:

a first paddle end, the first paddle end having a first fixed blade;

a second paddle end comprising a handle for gripping the SUP paddle;

a shaft connecting the first paddle end with fixed blade to the second paddle end with handle for gripping;

a housing incorporating into said shaft proximate to said second paddle end with handle;

a second, folding blade housed within said housing comprised of a first and second set of interlocking fan blades oriented along a length of a reference axis defined by the length of said paddle shaft said interlocking fan blades configured to move in a direction perpendicular to the reference axis;

wherein the first set of fan blades moves in a first plane along a −X axis direction that is perpendicular to the reference axis, wherein the second set of fan blades moves in the first plane along a +X axis direction that is perpendicular to the reference axis, such that said second folding blade can be collapsed and secured within said housing when not needed for paddling, and expanded out from said housing for use in paddling.

3. The SUP paddle of claim 2, wherein in order to achieve the expanded position the first set of fan blades are moved outwards in the first plane along the −X axis direction that is perpendicular to the reference axis, and wherein the second set of fan blades are moved outwards in the first plane along the +X axis direction that is perpendicular to the reference axis.

4. The SUP paddle of claim 2, wherein in order to achieve the closed position after the open position, the first set of fan blades are moved inwards in the first plane along the −X axis direction that is perpendicular to the reference axis, and wherein the second set of fan blades moved inwards in the first plane along the +X axis direction that is perpendicular to the reference axis.

5. The SUP paddle of claim 2, further comprising a locking mechanism to lock the position of the second folding blade in one of an expanded position or a collapsed position.

6. The SUP paddle of claim 5, wherein said locking mechanism further provides a means for mechanically expanding and collapsing said second folding blade.

7. The SUP paddle of claim 2, wherein the first fixed blade is oriented in the same plane as the second folding blade when the second folding blade is in expanded format.

8. The SUP paddle of claim 2, wherein the first fixed blade is oriented in a plane perpendicular to the plane of the second folding blade when the second folding blade is in expanded format.

9. The SUP paddle of claim 2, wherein when the second, folding blade is in the collapsed position, the SUP paddle is used for stand-up paddle surfing.

10. The SUP paddle of claim 2, wherein when the second, folding blade is in the expanded position, the SUP paddle is used for kayaking-style paddling.

11. The SUP paddle of claim 2, wherein one or more of the fan blades are reinforced along a portion of their length or width.

12. The SUP paddle of claim 2, wherein the shaft is made length-adjustable.

13. The SUP paddle of claim 2, wherein the shaft can be disassembled into two or more pieces for easy stowage of the SUP paddle.

14. The SUP paddle of claim 2, wherein the shaft comprises at least two lengths that can be rotated one relative to the other a quarter turn such that the fixed blade and folding blade extend either parallel or perpendicular to one another.

15. A method for converting a standup paddle board (SUP) paddle to a kayak-style paddle, the method comprising:

disengaging a collapsible paddle blade comprising a first and second set of fan blades housed within the shaft of an SUP paddle proximate to a handle for gripping, said handle for gripping disposed at one end of said shaft and a fixed blade disposed at the opposing end of said shaft;

expanding said collapsible paddle blade from within said housing along a plane perpendicular to a reference axis defined by the paddle shaft such that the first set of fan blades moves in a first plane along a −X axis direction that is perpendicular to the reference axis, and the second set of fan blades moves in the first plane along a +X axis direction that is perpendicular to the reference axis;

using said converted paddle with expanded collapsible blade for kayak-style paddling.

16. The method of claim 15, wherein the SUP paddle is converted back from a kayak-style paddle to SUP paddle by collapsing said collapsible paddle blade into said housing along a plane perpendicular to a reference axis defined by the paddle shaft such that the first set of fan blades moves in a first plane along a +X axis direction that is perpendicular to the reference axis, and the second set of fan blades moves in the first plane along a −X axis direction that is perpendicular to the reference axis, stowing the collapsible blade inside the shaft housing, and using the paddle with collapsed and stowed blade as a SUP paddle.

* * * * *